US009523252B2

(12) United States Patent
White et al.

(10) Patent No.: US 9,523,252 B2
(45) Date of Patent: Dec. 20, 2016

(54) FLOATING DEVICE RUNNING TOOL

(71) Applicant: WEATHERFORD TECHNOLOGY HOLDINGS, LLC, Houston, TX (US)

(72) Inventors: Nicky A. White, Poteau, OK (US); James W. Chambers, Houston, TX (US); Thomas F. Bailey, Abilene, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 160 days.

(21) Appl. No.: 14/506,411

(22) Filed: Oct. 3, 2014

(65) Prior Publication Data

US 2015/0096766 A1 Apr. 9, 2015

Related U.S. Application Data

(60) Provisional application No. 61/887,140, filed on Oct. 4, 2013.

(51) Int. Cl.
*E21B 23/00* (2006.01)
*E21B 23/01* (2006.01)
*E21B 23/04* (2006.01)

(52) U.S. Cl.
CPC ..... *E21B 23/00* (2013.01); *E21B 23/006* (2013.01); *E21B 23/01* (2013.01); *E21B 23/04* (2013.01)

(58) Field of Classification Search
CPC ..... E21B 23/00; E21B 23/006; E21B 23/01; E21B 23/04
See application file for complete search history.

(56) References Cited

U.S. PATENT DOCUMENTS 3,354,950 A * 11/1967 Hyde ..... E21B 17/07 166/336
4,022,281 A * 5/1977 Pennock ..... E21B 23/02 166/341
4,273,372 A * 6/1981 Sheshtawy ..... E21B 17/06 166/212

(Continued)

FOREIGN PATENT DOCUMENTS

EP 0658683 A1 6/1995
WO 2012001426 A2 1/2012

OTHER PUBLICATIONS

Australian Examination Report issued Apr. 4, 2016 for AU Patent Application No. 2014331598, 2 pages.

(Continued)

*Primary Examiner* — Matthew R Buck
(74) *Attorney, Agent, or Firm* — Smith IP Services, P.C.

(57) ABSTRACT

A running tool and delivery and/or retrieving apparatus, and method for use, are designed for optionally delivering and optionally retrieving an oilfield device down a borehole. A kelly extends into the borehole. The tool has a journal configured for slidable movement along the kelly, an engagement disk mounted around the journal configured for engaging the device, and a plurality of fins attached perpendicular to an outer circumference of the journal. The proximal fins extend radially from the outer circumference of the journal toward the engagement disk, are butted against the engagement disk and extend to a diameter complementary to an outer diameter of the engagement disk. The plurality of proximal fins surround and are arranged concentric with the journal.

17 Claims, 11 Drawing Sheets

(56) References Cited

U.S. PATENT DOCUMENTS

| | | | | |
|---|---|---|---|---|
| 4,624,311 | A | 11/1986 | Goad | |
| 4,693,316 | A * | 9/1987 | Ringgenberg | E21B 17/07 166/355 |
| 4,836,288 | A * | 6/1989 | Wester | E21B 47/1025 166/340 |
| 5,069,288 | A * | 12/1991 | Singeetham | E21B 33/043 166/208 |
| 6,039,118 | A * | 3/2000 | Carter | E21B 17/07 166/355 |
| 6,070,670 | A * | 6/2000 | Carter | E21B 17/07 166/242.7 |
| 6,401,827 | B1 | 6/2002 | Ferguson et al. | |
| 7,699,109 | B2 | 4/2010 | May et al. | |
| 8,316,945 | B2 * | 11/2012 | Robichaux | E21B 17/01 166/339 |
| 8,443,895 | B2 * | 5/2013 | Harms | E21B 23/006 166/339 |
| 2005/0115715 | A1 * | 6/2005 | Howlett | E21B 17/01 166/368 |
| 2009/0139724 | A1 | 6/2009 | Gray et al. | |
| 2010/0038096 | A1 * | 2/2010 | Reimert | E21B 23/01 166/382 |
| 2013/0175044 | A1 * | 7/2013 | Telfer | E21B 17/1007 166/358 |

OTHER PUBLICATIONS

Simunec, Duro, International Search Report, May 19, 2015, 3 pages, European Patent Office, Rijswijk, Netherlands.

Simunec, Duro, Written Opinion of the International Searching Authority, May 19, 2015, 7 pages, European Patent Office, Rijswijk, Netherlands.

* cited by examiner

FLOATING DEVICE RUNNING TOOL

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A "SEQUENCE LISTING", A TABLE, OR A COMPUTER PROGRAM

Not Applicable.

BACKGROUND

Technical Field

The subject matter generally relates to running tools used in the field of oil and gas operations. More specifically, the invention relates to a running tool adapted compensate for rig heave while delivering and retrieving an oilfield device or wellbore component to a desired location.

An oil or gas well includes a wellbore extending from the surface of the well to some depth therebelow. In the completion and operation of wells, down hole components are routinely inserted or run into the well and removed therefrom for a variety of purposes.

The well may have pressure control equipment placed near the surface of the well to control the pressure in the wellbore while drilling, completing and producing the wellbore. The pressure control equipment may include blowout preventers (BOP), rotating control devices (RCDs), and the like. The rotating control device or RCD is a drill-through device with a rotating seal that contacts and seals against the drill string (drill pipe, casing, drill collars, etc.) for the purposes of controlling the pressure or fluid flow to the surface. For reference to an existing description of a rotating control device incorporating a system for indicating the position of a latch in the rotating control device, please see US patent publication number 2009/0139724 entitled "Latch Position Indicator System and Method", U.S. application Ser. No. 12/322,860, filed Feb. 6, 2009, the disclosure of which is hereby incorporated by reference. At certain times and/or for maintenance of the RCD, the bearing may need to be removed from the RCD body, and a new bearing may need to be reinstalled. With the bearing package removed, the inside of the RCD may be susceptible to damage from the drilling environment. The RCD body contains various ports, such as bearing lubrication ports, hydraulic sealing ports, and other mechanisms which require protection in order to operate properly when the bearing package is subsequently reinserted into the RCD. A protective sleeve, delivered by way of a running tool to the desired location, may be used to protect the inner bore of the RCD during these times.

Wellbore components and oilfield devices, including protective sleeves and bearing assemblies, are typically run into the wellbore on a string with a running tool disposed between the lower end of the string and the wellbore component. Once the wellbore component is at a predetermined depth in the well, it is actuated by mechanical or hydraulic means in order to become anchored in place in the wellbore. Hydraulically actuated wellbore components require a source of pressurized fluid from the string thereabove to actuate slip members fixing the component in the wellbore, to inflate sealing elements, etc. Once actuated, the wellbore components are separated from the running tool, typically through the use of some temporary mechanical connection which is caused to fail by a certain mechanical or hydraulic force applied thereto. The running tool can then be retrieved and removed from the well.

However, in offshore drilling operations, the process of running wellbore components or oilfield devices often presents additional challenges. The rig and/or vessel are expected to experience significant heave and movement because of the ocean environment. Riser assemblies below offshore rigs often include slip joints to compensate for tension and ocean fluctuations, but additional compensation is often required when running the oilfield device into position, which may experience damage in route to the location due to heave. For example, in practice, offshore drilling operations frequently operate without a protective sleeve in place or potentially risk damage to the sleeve due to setting excessive force on the sleeve, both of which may have undesirable consequences. In addition, the wellbore components or oilfield devices also need to be safely retrieved or removed once they are no longer needed at the site.

There is a need therefore, for a running tool adapted to deliver and/or retrieve oilfield devices to and from a desired location while compensating for the risk and dangers of rig and/or vessel heave.

BRIEF SUMMARY OF THE EMBODIMENTS

A running tool and delivery and/or retrieving apparatus, and method for use, are designed for optionally delivering and optionally retrieving an oilfield device down a borehole. A body or kelly extends into the borehole. The tool has a journal configured for slidable movement along the body, an engagement disk mounted around the journal configured for engaging the device, and a plurality of fins attached perpendicular to an outer circumference of the journal. The proximal fins extend radially from the outer circumference of the journal toward the engagement disk, are butted against the engagement disk and extend to a diameter complementary to an outer diameter of the engagement disk. The plurality of proximal fins surround and are arranged concentric with the journal.

As used herein the term "journal" shall refer to one or more bushings, one or more mandrels, one or more collars, or integral piece of mandrel(s), bushing(s) and/or collar(s).

BRIEF DESCRIPTION OF THE SEVERAL VIEWS OF THE FIGURES

The embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DETAILED DESCRIPTION OF THE PREFERRED EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
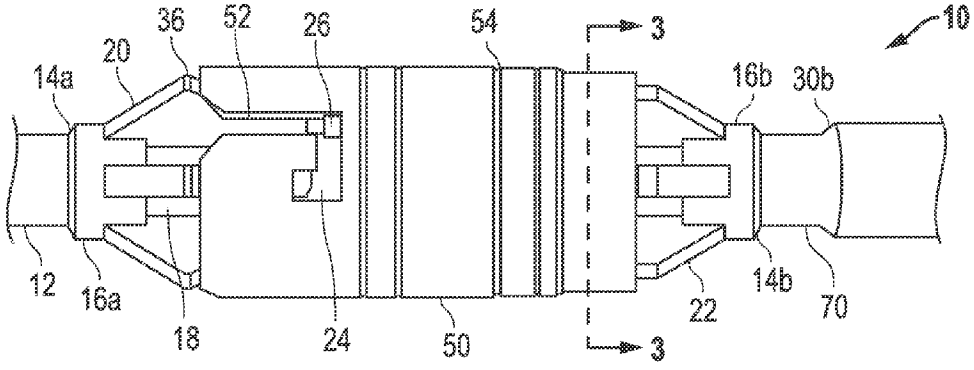
FIG. 1 depicts a schematic overview of an embodiment of a running tool.
Figure 2:
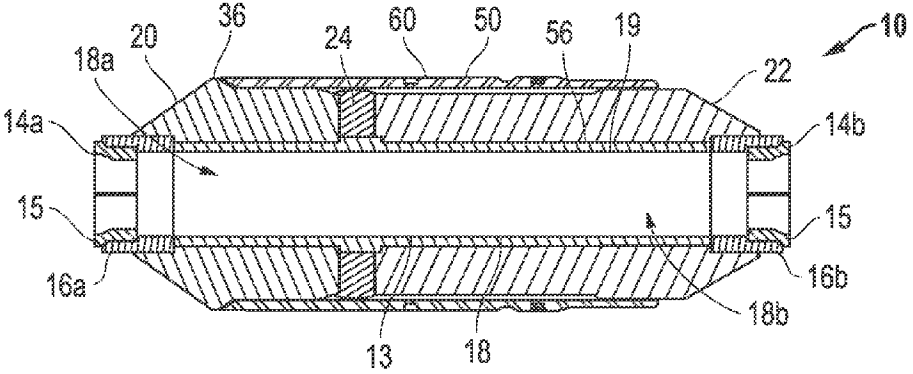
FIG. 2 depicts a cross sectional view of an embodiment of a running tool.
Figure 3:
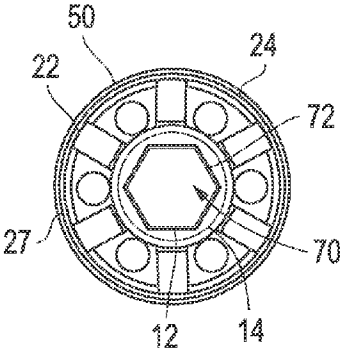
FIG. 3 depicts a sectional view taken along line 3-3 of FIG. 1.
Figure 3A:
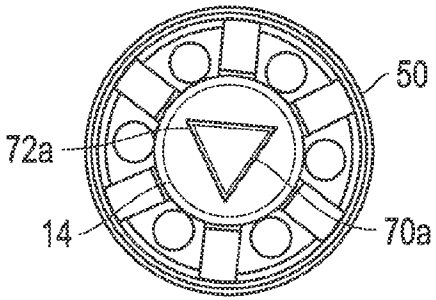
FIG. 3A depicts a cross sectional view of an embodiment of a running tool wherein the running tool is mounted on a body or kelly of triangular shape in cross section.
Figure 3C:
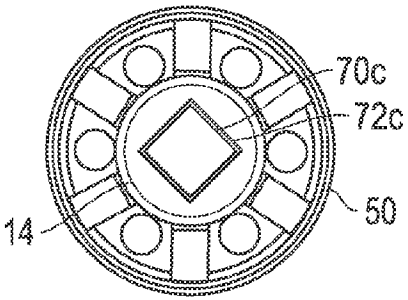
FIG. 3C depicts a cross sectional view of an embodiment of a running tool wherein the running tool is mounted on a body or kelly of square shape in cross section.
Figure 3E:
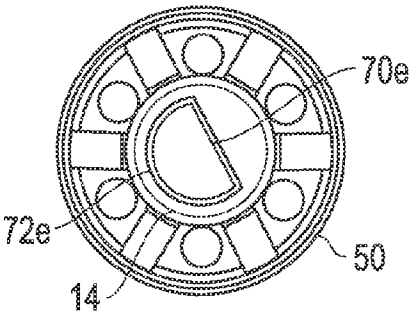
FIG. 3E depicts a cross sectional view of an embodiment of a running tool wherein the running tool is mounted on a body or kelly with a milled flat in cross section.
Figure 3B:
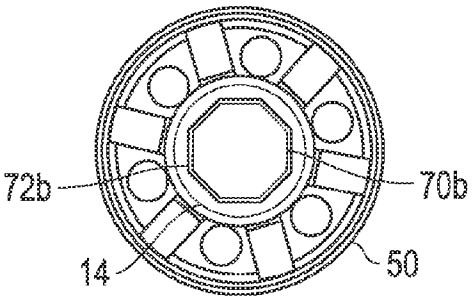
FIG. 3B depicts a cross sectional view of an embodiment of a running tool wherein the running tool is mounted on a body or kelly of octagonal shape in cross section.
Figure 3D:
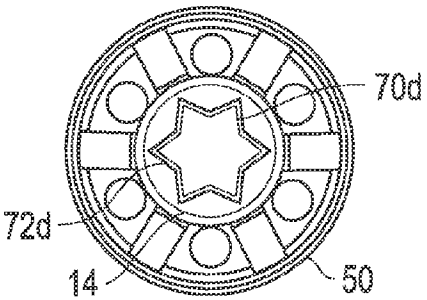
FIG. 3D depicts a cross sectional view of an embodiment of a running tool wherein the running tool is mounted on a body or kelly of splined shape in cross section.
Figure 3F:
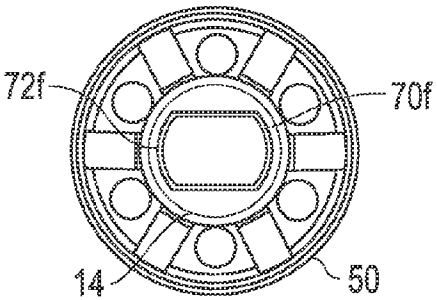
FIG. 3F depicts a cross sectional view of an embodiment of a running tool wherein the running tool is mounted on a body or kelly with two milled flats in cross section.

FIGS. 1-3 and 8 depict one embodiment of a running tool. The running tool 10 is mounted on a kelly 12 (e.g. in this embodiment a modified hex kelly bar) to deliver protective sleeve 50 or device 60 (see FIGS. 2 & 10) to the desired location in the wellbore. While FIG. 1 is illustrated with a protective sleeve 50, it is to be appreciated that running tool 10 may also be used to deliver and retrieve any of the following oilfield devices 60, including, but not limited to: a bearing assembly, a snubbing adapter, a logging adapter, or any other wellbore components or oilfield devices that may be run down hole and latched in place for specialized rig operations. Drilling rigs used in drilling oil and gas wells may employ a kelly 12 that may be polygonal or splined in cross section. The kelly 12 may extend down into a borehole. The kelly 12 may, for example, be connected to a drill string on the lower end and be connected to a fluid swivel joint at the upper end. The kelly 12 may be provided with a drive bushing that connects through a rotary table at the derrick floor level and can move vertically through the drive bushing to impart rotation to the drill string. Although the kelly 12 is illustrated as hexagonal in cross section in FIG. 3, it should be appreciated that the kelly 12 may be of any shape in cross section, including, but not limited to, triangular, square, octagonal, or splined. As mentioned, mounting the running tool 10 on a hex-kelly 12 is merely one embodiment of the present disclosure. Alternative embodiments include mounting the running tool 10 on any body 70 (regardless of whether referred to as a "kelly" or not, i.e. the kelly 12 is a type of body 70) capable of transmitting torque as well as not inhibiting (with the exception of friction) axial sliding motion within an axial range of motion (the distance of the axial range of motion to be determined by one of ordinary skill in the art accounting for the significance of heave). Other variations or embodiments of the body 70 include, by way of example only but not limited to, a tube or bar with a triangular body 70*a* (FIG. 3A), an octagonal body 70*b* (FIG. 3B), a square body 70*c* (FIG. 3C), a splined body 70*d* (FIG. 3D), a milled flat body 70*e* (FIG. 3E), or a body with two milled flats 70*f* (FIG. 3F). The internal surface or bore 19 of a hollow length of sub, journal 15 or mandrel 18 surrounds an external surface 13 of kelly 12, forming a mating internal surface to the angles or splines of the kelly 12, and thus constituting the base of the embodiment in FIG. 1. The internal surface 19 may or may not be contiguous with the external surface 13 of kelly 12. At both ends of the mandrel 18 are bushings 14 (or journals 15), also fitted to have internal surface(s) 72 (i.e. in the FIG. 3 embodiment hexagonal) complementary to external surface of the kelly 12, i.e. capable of transferring rotation-to-rotation movement, (in FIG. 3A bushing 14 defining triangular internal surfaces 72*a*, in FIG. 3B bushing 14 defining octagonal internal surfaces 72*b*, in FIG. 3C bushing 14 defining square internal surfaces 72C, in FIG. 3D bushing 14 defining splined internal surfaces 72*d*, in FIG. 3E bushing 14 defining internal surfaces 72*e*, and in FIG. 3F bushing 14 defining internal surfaces 72*f*). The running tool 10 may also feature an end cap or collar 16 surrounding each bushing 14. A proximal collar 16*a* may surround a proximal bushing 14*a*, where the proximal collar 16*a* is attached to the proximal end 18*a* of the mandrel 18. A distal collar 16*b* may surround a distal bushing 14*b*, where the distal collar 16*b* is attached to the distal end 18*b* of the mandrel 18. Further, the proximal collar 16*a* may be welded to the mandrel 18. The distal collar 16*b* may also be welded to the mandrel 18. Although running tool 10 is illustrated with both bushings 14 and collars 16, it should be appreciated that either bushings 14 or collars 16 can be utilized individually as well. The mandrel 18 and bushings 14 are slidably movable along the axis of the kelly 12 in order to compensate for movement from rig heave. The slidable movement, and thus the range of the ability of the running tool 10 to compensate for the transferred motion from rig heave, is limited at either end of the kelly 12 by floating limit surfaces 30*a* and 30*b*, which possess a larger circumference than the kelly 12. The kelly 12 can induce rotational movement of the journal 15 (i.e. mandrel 18, bushings 14 and/or collars 16) about the axis, but the running tool 10 and its components do not rotate freely without rotation of the kelly 12 as driven by the kelly drive and drill pipe attached as known to those skilled in the art (e.g. a drill pipe joint 34).

Attached to the proximal bushing 14*a* or proximal collar 16*a* are a number or plurality of proximal fins 20 extending towards the middle of the length of mandrel 18, arranged concentrically around the axis defined by kelly 12. Proximal bushing 14*a* surrounds the kelly 12 and is connected to the proximal end 18*a* of the mandrel 18. Proximal bushing 14*a* is also configured for slidable movement along the kelly 12. The plurality of proximal fins 20 are attached perpendicular to an outer circumference 56 of the proximal end 18*a* of the mandrel 18. Alternatively, proximal fins 20 may be attached to proximal bushing 14*a*. In addition, proximal fins 20 may be welded to the mandrel 18. The proximal fins 20 extend radially along from the outer circumference 56 of the mandrel 18 towards the engagement disk or instrument 24. The proximal fins 20 may butt against engagement disk 24 and extend to a diameter complementary to an outer diameter 27 of the engagement disk 24. At the other end, attached to the distal bushing 14*b* or distal collar 16*b* are a number or plurality of distal fins 20 extending towards the middle of the length of mandrel 18. Distal bushing 14*b* surrounds the kelly 12 and is connected to the distal end 18*b* of the mandrel 18. Distal bushing 14*b* is configured for slidable movement along the kelly 12. The distal fins 22 are attached perpendicular to an outer circumference 56 of the distal end 18*b* of the mandrel 18. In an alternative embodiment, distal fins 22 may be attached to distal bushing 14*b*. In addition, distal fins 22 may be welded to mandrel 18. Further, the distal fins 22 extend radially from the outer circumference 56 of the mandrel 18 towards the engagement disk 24 and are butted against the engagement disk 24. The proximal fins 20 and distal fins 22 surround and are arranged concentrically with the mandrel 18. Proximal fins 20 and distal fins 22 may be secured to mandrel 18 via welding, bolts, or any other means known to one of ordinary skill in the art. In addition, although the embodiment of FIG. 1 shows a certain number of proximal fins 20 and distal fins 22, it is to be appreciated that any number of fins may be used. By way of example only, and not limited to, the number of proximal fins 20 may be six and the number of distal fins 22 may be six. Each of the proximal fins 20 may also feature a fin ridge 36 forming a larger circumference near to the bushing 14*a* or collar 16*a* by protruding radially to a distance beyond the outer diameter 27 of the engagement disk 24. The fin ridge 36 of the proximal fins 20 limits the upward movement of protective sleeve 50 (or other device 60), thereby helping to retain the protective sleeve 50 or device 60 on the running tool 10 before protective sleeve 50 or device 60 is deposited at its intended location.

Figure 7:
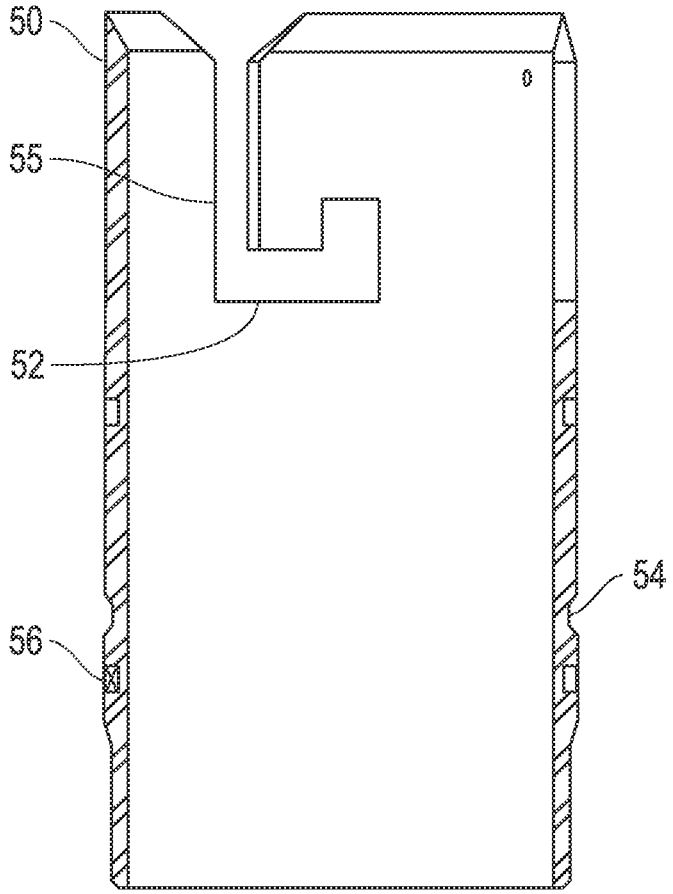
FIG. 7 depicts a schematic overview in cross section of an embodiment of a protective sleeve.
Figure 8:
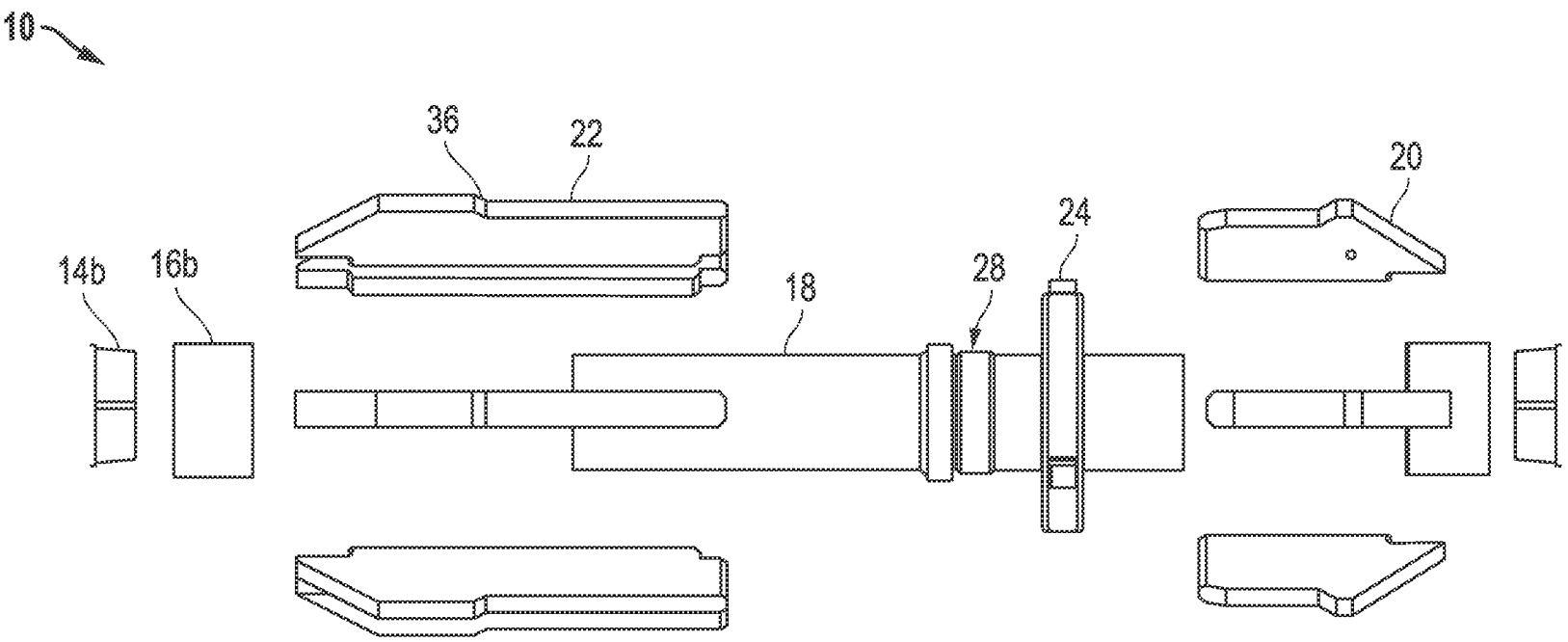
FIG. 8 depicts an exploded view of the embodiment shown in FIGS. 1-2.
Figure 10:
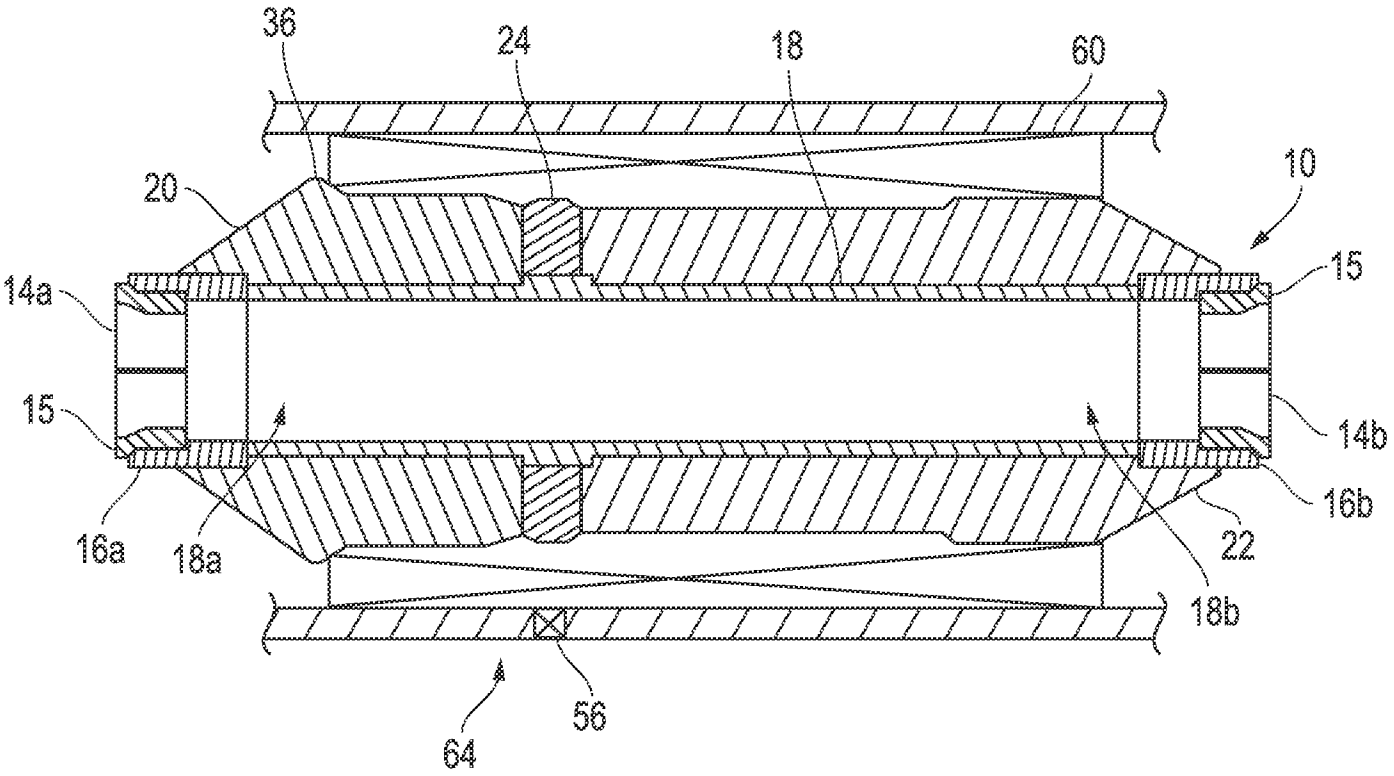
FIG. 10 depicts a schematic overview of a generalized device mounted on a running tool for down hole delivery and/or retrieval.

Running tool 10 further includes an engagement disk 24. In one embodiment the engagement disk 24 is a relatively flat discus of certain thickness, placed in between the proximal fins 20 and the distal fins 22 and has a bore circumference which accommodates mandrel 18. However, engagement disk or instrument 24 is not limited to a discus form, and may be any instrument capable of anchoring a device 60 to the engagement instrument 24 and configured to slidably move along a body 70. A disk seat 28 (see FIG. 8) may be formed or mounted on or around the mandrel 18 for seating of the engagement disk 24. The disk seat 28 may be secured to the outer circumference or diameter 56 of the mandrel 18. The proximal fins 20 and distal fins 22 may butt against engagement disk 24. The engagement disk 24 is threaded, or otherwise attached or secured by any manner known to one of ordinary skill in the art, to mandrel 18 and the disk seat 28. By way of example only, the engagement disk 24 is torqued to at least 400 ft.-lbs. The protective sleeve 50 or device 60 defines a J-slot 52 as the anchoring means 55, as is illustrated in FIG. 7. In addition, the engagement disk 24 features an engagement disk prong 26 designed to interact or engage with J-slot 52 to anchor protective sleeve 50 or device 60 into the desired position via a selective interaction with the J-slot 52. When the protective sleeve 50 or device 60 is locked into position on running tool 10, the protective sleeve 50 or device 60 is retained onto running tool 10 as it moves along the kelly 12. The locked position is used when lowering, retrieving, or otherwise maneuvering the protective sleeve 50 or device 60 into the desired location within the wellbore. When in the locked position on the running tool 10, the protective sleeve 50 or device 60 is shielded from significant rig heave damage as the energy from the rig heave is transferred or absorbed by the sliding motion of the running tool 10 along the kelly 12. When at the desired location, the running tool 10 can safely deposit protective sleeve 50 or device 60 by first allowing a down hole latching mechanism to latch onto a groove or recess 54 defined on the external surface of the protective sleeve 50 or device 60. Referring to FIGS. 1, 2 and 10 sensors 56 may optionally be implemented on the device 60 or latching or docking location 64, such as on or near the grooves or recess 54, and may also be placed at the desired location within the wellbore to indicate that the device 60 is at its desired position, or to determine distance from the desired location. These sensors 56 may be a magnetic or proximity type sensor, but may also include other sensors which may be used with drilling mud. Next, whilst latched, the tool 10 can continue to slide up and/or down on the kelly 12, then, induce movement of the engagement disk prong 26 into the unlocking position on J-slot 52, and, last, retrieve the running tool 10 out of the borehole. Rotational movement of engagement disk prong 26 is accomplished by rotating the kelly 12 through the rotary table. When a protective sleeve 50 or device 60 requires removal, the running tool 10 is lowered into the borehole and engagement disk prong 26 interacts with J-slot 52 to anchor the protective sleeve 50 or device 60 via rotational movement of the kelly 12. Once the protective sleeve 50 or device 60 is anchored onto the running tool 10, the protective sleeve 50 or device 60 and running tool 10 may be retrieved by removing the drill string out of the borehole.

Although the figures illustrate anchoring means 55 via a locking J-slot 52 mechanism, it is to be appreciated that any other anchoring means 55 whether mechanical, hydraulic, or pneumatic and optionally with any external source of power or actuation may be employed to position, anchor, or engage the protective sleeve 50 or device 60, as may be best determined by one of ordinary skill in the art.

Figure 4:
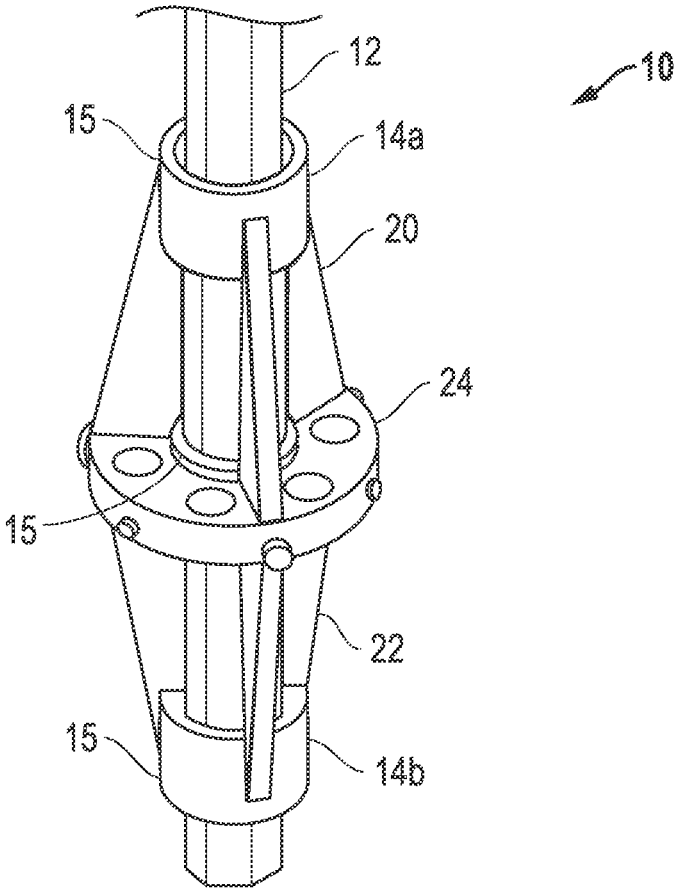
FIG. 4 depicts a schematic overview of an alternative embodiment of a running tool.
Figure 5:
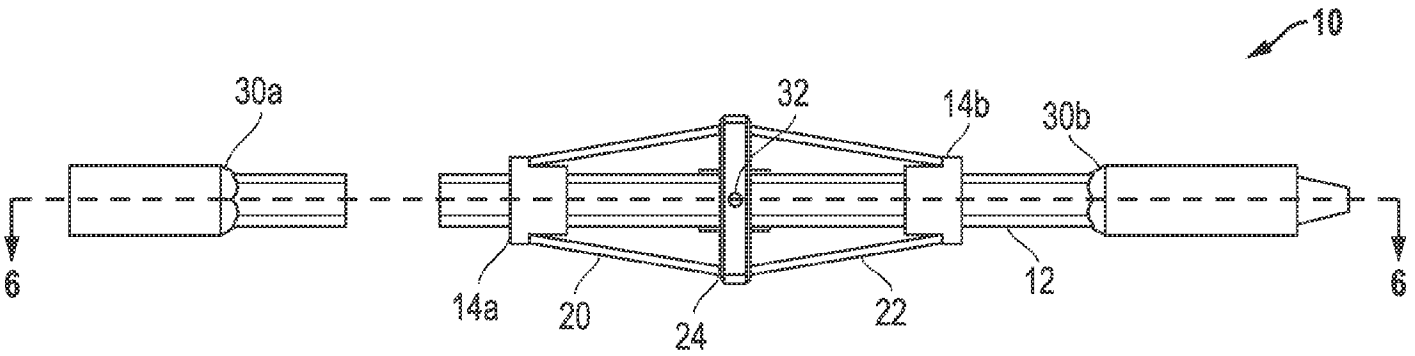
FIG. 5 depicts a schematic overview of an alternative embodiment of a running tool
Figure 6:
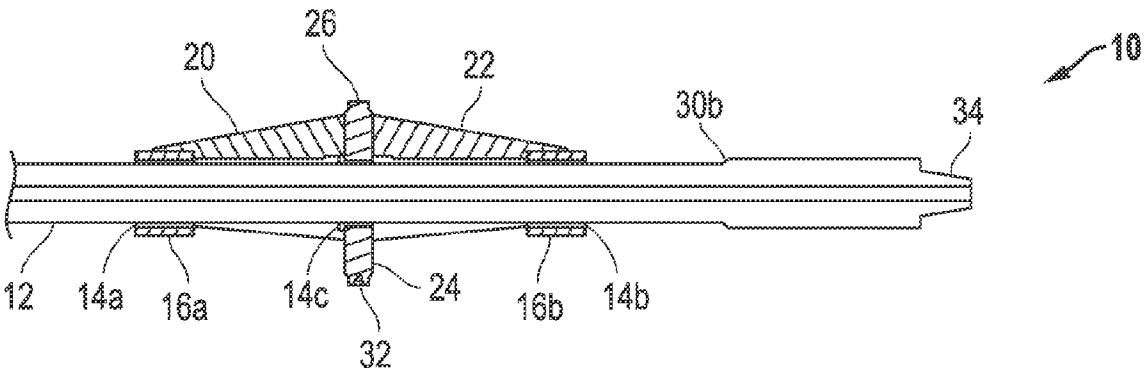
FIG. 6 depicts a sectional view taken along line 6-6 of FIG. 5.

FIGS. 4-6 depict a schematic overview of an alternative embodiment of a running tool on a kelly. In the embodiments in FIGS. 4-6, running tool 10 has journals 15 or proximal and distal bushings 14*a* and 14*b* on which proximal fins 20 and distal fins 22 are mounted on, respectively. Engagement disk 24 is also mounted on an intermediate bushing 14*c* between proximal bushing 14*a* and distal bushing 14*b*. Notably the embodiment in FIGS. 4-6 does not include a mandrel 18 as illustrated in the embodiment in FIG. 1. In addition, proximal fins 20 and distal fins 22 in FIG. 4 may also be fastened to engagement disk 24 via bolts 32, or any other means known to one of ordinary skill in the art. The running tool 10 in FIG. 4 is also slidably movable along the axis of kelly 12 so as to compensate for rig heave. The distance of slidable movement along the axis of kelly 12 may be confined to a range through implementation of the floating limit surfaces 30 and 30*b* on the kelly 12. The rotational movement of the running tool 10 is determined by and controlled the rotation of the kelly 12.

Figure 9:
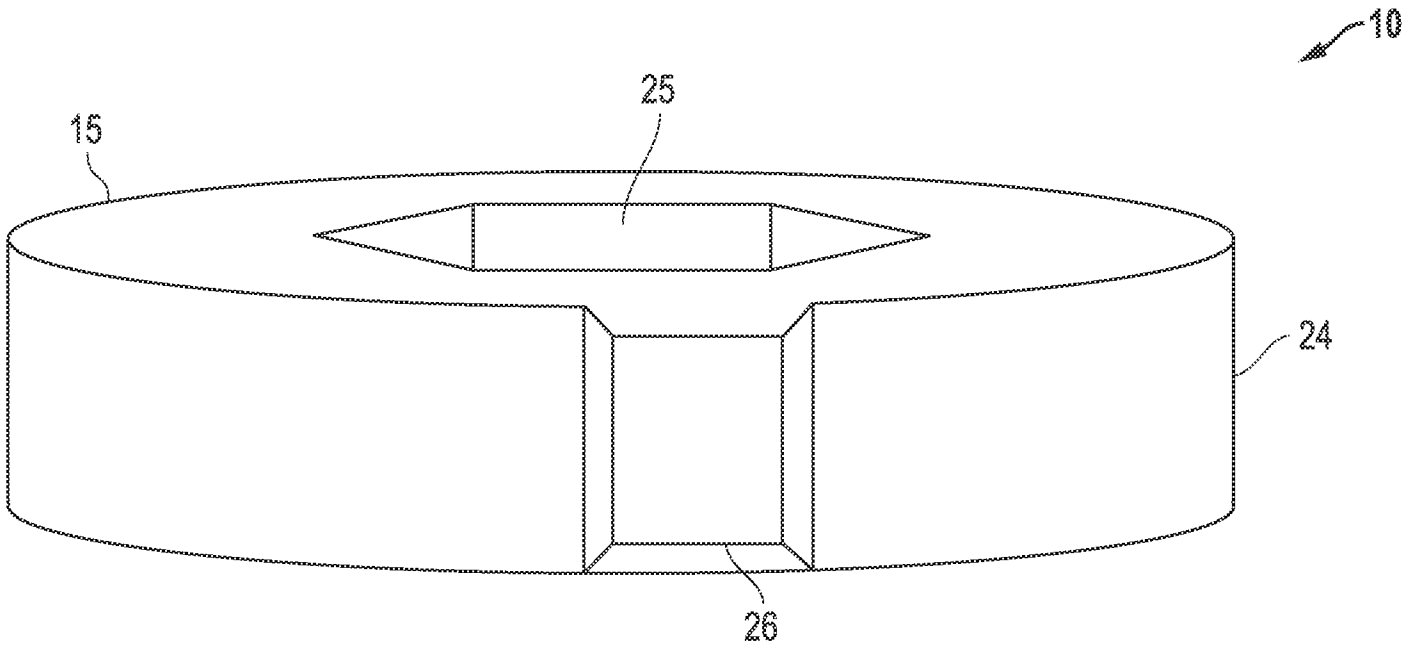
FIG. 9 depicts a schematic overview of an alternative embodiment of a running tool.

FIG. 9 depicts a schematic overview of an alternative embodiment of a running tool 10. On FIG. 9, running tool 10 is an engagement disk or instrument 24 having an inner bore 25 complementary to an external surface 13 of the kelly 12. The engagement disk 24 has a disk prong 26 for engaging the protective sleeve 50 or device 60. The engagement disk 24 via journal 15 is slidably movable along the kelly 12.

Figure 11:
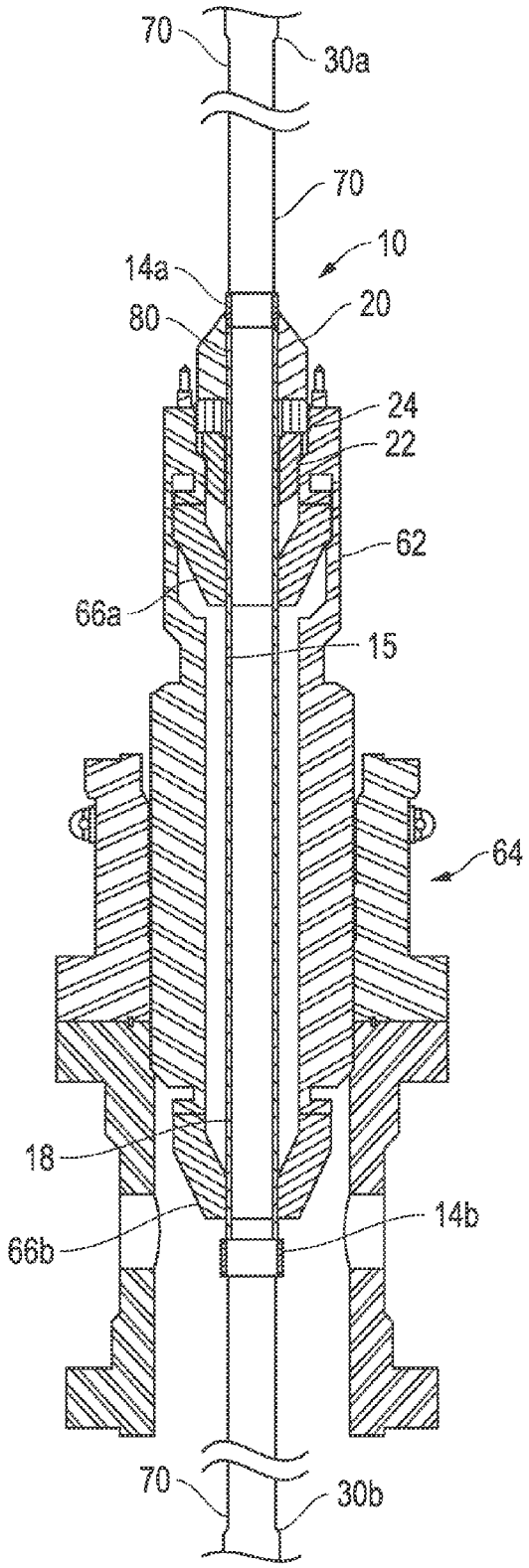
FIG. 11 depicts a schematic overview of a bearing assembly mounted on a running tool for down hole delivery and/or retrieval.

FIG. 10 depicts a schematic overview of an embodiment of a running tool 10 that can be used to deliver a device 60 (via journal 15 or proximal and distal bushings 14*a* and 14*b*) which is inclusive of a protective sleeve 50 but also includes other devices 60, such as, for example, a bearing assembly 62 (see FIG. 11 wherein the mandrel 18 or journal 15 extends through and supports the RCD seals 66*a*, 66*b* in the bearing assembly 62 and the engagement disk 24 connects to the bearing assembly 62 for disconnect when at the proper level and alignment at the latching or docking location 64), a snubbing adapter or a logging adapter down hole.

Figure 12:
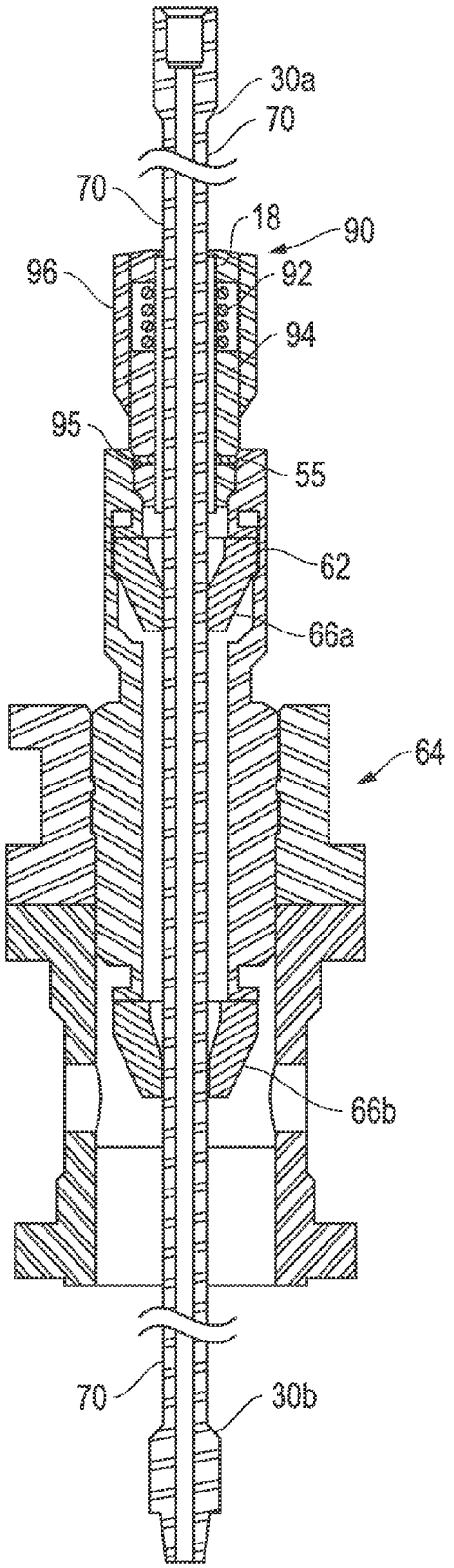
FIG. 12 depicts a schematic overview of a bearing assembly mounted on a mechanical running tool for down hole delivery and/or retrieval.

FIG. 12 illustrates an embodiment of a schematic overview of a bearing assembly 62 mounted on a floating mechanical running tool 90 for down hole delivery and/or retrieval. The floating mechanical running tool 90 as an engagement instrument includes a spring 92 loaded driver 94 which drives latch(es) 95 (functioning as the anchoring means 55 in this embodiment); all of which are mounted in a casing 96 and optionally mounted on mandrel 18. In an embodiment with or without mandrel 18 (or journal 15), the floating mechanical running tool 90 is configured to slidably move along the axis of the body 70 in such a manner so as to compensate for rig heave (i.e. floating independently of the drill string). The floating mechanical running tool 90 connects to the bearing assembly 62 through the anchoring means 55 (latch(es) 95 in this embodiment) for disconnect when at the proper downhole level and alignment at the latching or docking location 64. In addition, bearing assembly 62 may also have RCD seals 66*a* and 66*b* which may lay adjacent to and is supported by the body 70.

Figure 13:
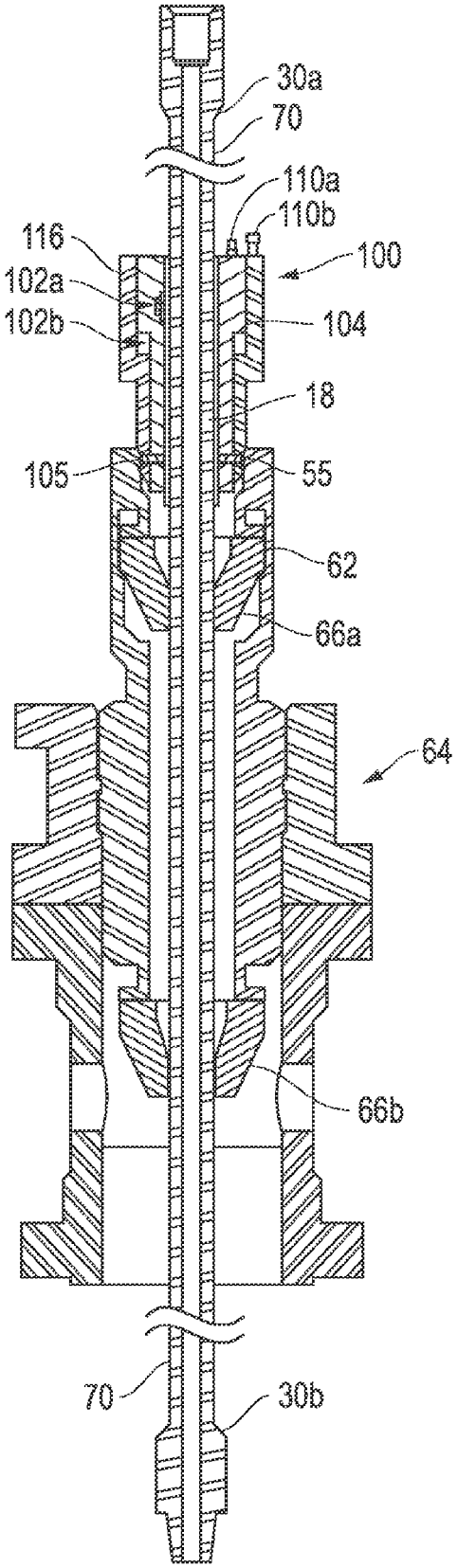
FIG. 13 depicts a schematic overview of a bearing assembly mounted on a pneumatic or hydraulic running tool for down hole delivery and/or retrieval.

FIG. 13 depicts a schematic overview of a bearing assembly 62 mounted on an externally powered floating pneumatic or hydraulic running tool 100 for down hole delivery and/or retrieval. The externally powered floating pneumatic or hydraulic running tool 100 as an engagement instrument includes a casing 116, fluid ports 110*a* and 110*b* through the casing 116, a plunger 104 which drives latch(es) 105 (functioning as the anchoring means 55 in this embodiment), and fluid chambers 102*a* and 102*b* (in fluid communication with fluid ports 110*a* and 110*b*); all of which are mounted in and/or defined by a casing 116 and optionally mounted on mandrel 18 (or journal 15). In an embodiment with or without mandrel 18, the floating pneumatic or hydraulic running tool 100 is configured to slidably move along the axis of the body 70 in such a manner so as to compensate for rig heave (i.e. floating independently of the drill string). The externally powered floating pneumatic or hydraulic running tool 100 connects to the bearing assembly 62 through anchoring means 55 (latch(es) 105 in this embodiment) for disconnect when at the proper level and alignment at the latching or docking location 64 to latch or unlatch bearing assembly 62. The fluid envisioned to actuate the externally powered floating pneumatic or hydraulic running tool 100 includes hydraulic or pneumatic fluids. In addition, bearing assembly 62 may also have RCD seals 66*a* and 66*b* which may lay adjacent to and is supported by the body 70.

While the embodiments are described with reference to various implementations and exploitations, it will be understood that these embodiments are illustrative and that the scope of the inventive subject matter is not limited to them. Many variations, modifications, additions and improvements are possible.

The running tool 10 could be used on land, and for pulling up any down hole item regardless of whether it is latched down hole. Although various embodiments might suggest the running tool 10 is for use only with an RCD docking station and below the tension ring on a riser, the use and implementation of the running tool 10 is not limited thereto. Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A running tool apparatus for conveying a device on a body configured to permit transmission of torque and to permit slidable axial motion within a borehole, the apparatus comprising:

a journal having an inner bore complementary to an external surface of the body, wherein the journal is configured for slidable movement along the body;

an engagement instrument connected to the journal, wherein the engagement instrument is configured for engaging the device;

a plurality of proximal fins attached to the engagement instrument, wherein the plurality of proximal fins surround and are arranged concentric with the body and extend radially therefrom, and extend to a diameter complementary to an outer diameter of the engagement instrument;

a proximal collar attached to the proximal fins, wherein the proximal collar includes a proximal bushing;

a plurality of distal fins attached to the engagement instrument, wherein the plurality of distal fins surround and are arranged concentric with the body and extend radially therefrom;

a distal collar attached to the distal fins; and wherein the distal collar includes a distal bushing.

2. The apparatus according to claim 1, wherein the engagement instrument comprises a spring loaded driver which drives a latch; all of which are mounted in a casing.

3. The apparatus according to claim 1, wherein the engagement instrument comprises a casing, two fluid ports through the casing, a plunger which drives a latch, and two fluid chambers defined by the casing and the plunger;

wherein the fluid chambers are in fluid communication with the fluid ports.

4. The apparatus according to claim 1, wherein the body includes a proximal floating limit surface and a distal floating limit surface; and wherein when the device is in an engaged position on the engagement instrument, then the engagement instrument is on the body bounded on one side by the proximal floating limit surface and bounded on another side by the distal floating limit surface.

5. A running tool apparatus for conveying a device within a borehole, the apparatus comprising:

a body extending down into the borehole, wherein the body is configured to permit the transmission of torque and to permit slidable axial motion;

a journal having an inner bore complementary to an external surface of the body, wherein the journal is configured for slidable movement along the body;

an engagement disk connected to the journal, wherein the engagement disk is configured for engaging the device;

a plurality of proximal fins attached perpendicular to an outer circumference of one end of the journal, wherein the proximal fins extend radially from the outer circumference of the journal towards the engagement disk, are butted against the engagement disk and extend to a diameter complementary to an outer diameter of the engagement disk, and wherein the plurality of proximal fins surround and are arranged concentric with the journal; and a plurality of distal fins attached perpendicular to an outer circumference of another end of the journal, wherein the distal fins extend radially from the outer circumference of the journal towards the engagement disk and are butted against the engagement disk, and wherein the plurality of distal fins surround and are arranged concentric with the journal.

6. The apparatus according to claim 5, wherein the plurality of proximal fins define a fin ridge protruding radially to a distance beyond the outer diameter of the engagement disk, configured for retaining the position of the device on the running tool.

7. The apparatus according to claim 5, wherein the journal is a mandrel, and further comprising:

a proximal bushing surrounding the body and connected to the proximal end of the mandrel, wherein the proximal bushing is configured for slidable movement along the body; and a distal bushing surrounding the body and connected to the distal end of the mandrel, wherein the distal bushing is configured for slidable movement along the body.

8. The apparatus according to claim 7, further comprising:

a proximal collar surrounding the proximal bushing, wherein the proximal collar is attached to the proximal end of the mandrel; and a distal collar surrounding the distal bushing, wherein the distal collar is attached to the distal end of the mandrel.

9. The apparatus according to claim 5, wherein the journal is a bushing.

10. The apparatus according to claim 5, wherein the device defines a J-slot; and wherein the engagement disk further comprises an engagement disk prong configured to engage the device via selective interaction with the J-slot.

11. The apparatus according to claim 5, wherein the journal includes a disk seat secured to an outer diameter of the journal; and wherein the engagement disk is secured to the disk seat.

12. The apparatus according to claim 5, wherein the body includes a proximal floating limit surface and a distal floating limit surface; and wherein when the device is in an engaged position on the engagement disk, then the engagement disk is on the body bounded on one side by the proximal floating limit surface and bounded on another side by the distal floating limit surface.

13. The apparatus according to claim 5, wherein the body is a kelly.

14. The apparatus according to claim 5, wherein the device is selected from the group consisting of a protective sleeve, a bearing assembly, a snubbing adapter, and a logging adapter.

15. A running tool apparatus for conveying a device on a body within a borehole, the apparatus comprising:

a proximal bushing surrounding the body, wherein the proximal bushing is configured for slidable movement along the body;

a distal bushing surrounding the body, wherein the distal bushing is configured for slidable movement along the body;

an intermediate bushing surrounding the body positioned between the proximal bushing and the distal bushing, wherein the intermediate bushing is configured for slidable movement along the body;

an engagement disk mounted around the intermediate bushing wherein the engagement disk is configured for engaging the device;

a plurality of proximal fins attached to the proximal bushing and to the engagement disk, wherein the proximal fins extend radially from the intermediate bushing and extend to a diameter complementary to an outer diameter of the engagement disk, and wherein the plurality of proximal fins are arranged concentric with the intermediate bushing; and a plurality of distal fins attached to the distal bushing and to the engagement disk, wherein the distal fins extend radially from the intermediate bushing and extend to the diameter complementary to the outer diameter of the engagement disk, and wherein the plurality of distal fins are arranged concentric with the intermediate bushing.

16. The apparatus according to claim 15, wherein the device defines a J-slot; and wherein the engagement disk further comprises an engagement disk prong configured to engage the device via selective interaction with the J-slot.

17. The apparatus according to claim 15, wherein the body includes a proximal floating limit surface and a distal floating limit surface; and wherein when the device is in an engaged position on the engagement disk, then the engagement disk is on the body bounded on one side by the proximal floating limit surface and bounded on another side by the distal floating limit surface.

* * * * *